US006095463A

United States Patent [19]

McCormick

[11] Patent Number: 6,095,463

[45] Date of Patent: Aug. 1, 2000

[54] BILLIARD TABLE FOOT AND LEG HEIGHT ADJUSTER

[75] Inventor: William R. McCormick, Kenosha, Wis.

[73] Assignee: Brunswick Billiards, Muskegon, Mich.

[21] Appl. No.: 09/170,360

[22] Filed: Oct. 13, 1998

Related U.S. Application Data

[60] Provisional application No. 60/082,890, Apr. 24, 1998.

[51] Int. Cl.[7] ..... F16M 11/24

[52] U.S. Cl. ..... 248/188.4; 248/157; 248/188.2; 248/188.5; 248/188.8; 248/346.05

[58] Field of Search ..... 248/157, 346.05, 248/188.2, 188.8, 188.4, 188.5

[56] References Cited

U.S. PATENT DOCUMENTS

| | | | |
|---|---|---|---|
| 156,927 | 11/1874 | Jewell . | |
| 180,251 | 7/1876 | May . | |
| 476,324 | 6/1892 | Starks . | |
| 785,982 | 3/1905 | Smith | 248/188.4 |
| 809,078 | 1/1906 | Seymour | 248/188.4 |
| 948,708 | 2/1910 | Sheppard | 248/188.4 |
| 972,287 | 10/1910 | Swift | 248/188.4 |
| 1,125,668 | 1/1915 | Deming . | |
| 1,305,427 | 6/1919 | Werner . | |
| 1,417,639 | 5/1922 | Sterner . | |
| 1,860,215 | 3/1932 | Young . | |
| 2,427,234 | 9/1947 | Sheppard | 248/157 |
| 5,071,097 | 12/1991 | Owen | 248/188.4 |
| 5,564,669 | 10/1996 | Wu | 248/346.01 |
| 5,743,505 | 4/1998 | Sofy | 248/346.01 |
| 5,794,912 | 8/1998 | Whittaker et al. | 248/638 |
| 5,881,979 | 3/1999 | Rozier, Jr. et al. | 248/188.5 |

*Primary Examiner*—Leslie A. Braun
*Assistant Examiner*—Walter Landry
*Attorney, Agent, or Firm*—Price, Heneveld, Cooper, DeWitt & Litton

[57] ABSTRACT

A billiard table leg and foot height adjuster comprising a bottom plate including at least one concentric bearing race and an upstanding peripheral rim, an upstanding boss in the center of the bottom plate, a billiard table support plate resting on the bearing race within the upstanding peripheral rim, an axle having a lower end, and an upper end projecting up through the boss and support plate, a snap ring retainer on the upper end of the axle for securing the support plate, and at least one set screw in the upstanding peripheral rim and projecting above the support plate to engage a billiard table foot. The foot includes a frust-oconical lower portion for rotatable adjustment of the foot by manually gripping and rotating the foot.

17 Claims, 3 Drawing Sheets

BILLIARD TABLE FOOT AND LEG HEIGHT ADJUSTER

CROSS-REFERENCE TO RELATED APPLICATIONS

This application claims priority under 35 U.S.C. §119(e) on U.S. Provisional Application No. 60/082,890, entitled BILLIARD TABLE FOOT AND LEG HEIGHT ADJUSTOR, filed Apr. 24, 1998, by William R. McCormick, the entire disclosure of which is incorporated herein by reference.

BACKGROUND OF THE INVENTION

This invention relates to billiard tables and particularly to a height adjustment device for the foot and leg of a billiard table, to enable leveling of the table and retention of the leveled condition once achieved.

Billiard tables are used to play games of pool, billiards and snooker. To properly play the game, the table playing surface must be absolutely level. Leveling is achieved by adjusting the height of each leg as necessary, using a threaded foot assembly. Several types of table leg adjustment devices have been devised over the years. Many of these are not suitable for a billiard table weighing hundreds of pounds. Commonly, height adjustment of billiard tables is achieved by one person manually lifting the weight off each corner of the table while a second person rotates the threaded device to adjust the foot height. U.S. Pat. No. 5,071,097 presents several embodiments of a table leg height adjuster not requiring a person to lift the table weight, and employing ball bearings or slide bearings while showing several types of handles or wings for applying torque to the adjuster.

SUMMARY OF THE INVENTION

An object of this invention is to provide a novel billiard table leg and foot height adjuster which is simple and easy to operate without manually lifting the table, to achieve a level table playing surface, is free of handles or wings so as to provide an aesthetically pleasing appearance, achieves a locking function for the adjusted foot, and can be retrofitted onto existing billiard tables without requiring affixing of the table foot to the adjusting device.

These and other features, advantages and objects of the present invention will be further understood and appreciated by those skilled in the art by reference to the following specification, claims and appended drawings.

DETAILED DESCRIPTION OF PREFERRED EMBODIMENT

Figure 1:
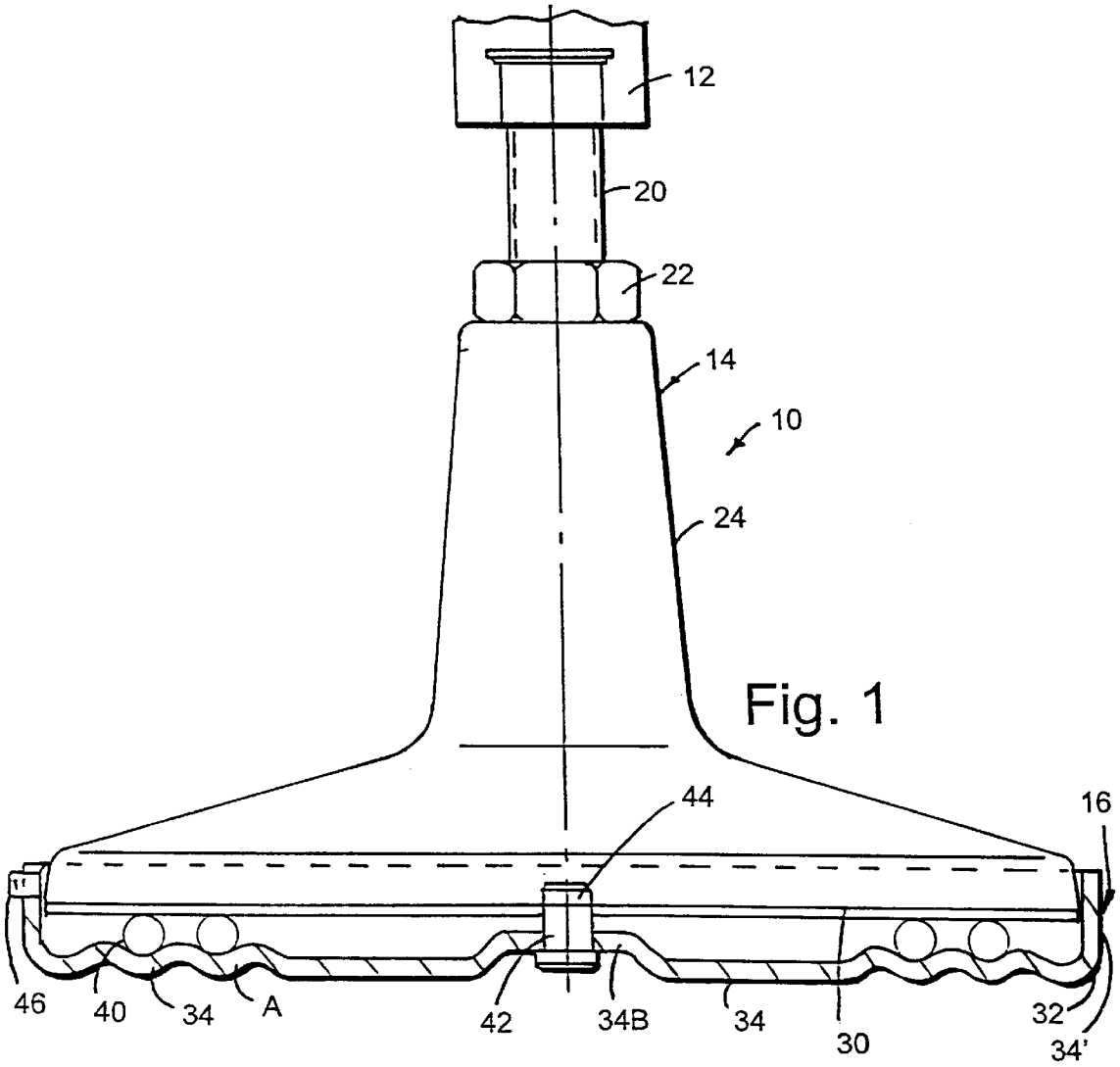
FIG. 1 is an elevational view of the adjusting device shown supporting a foot of a billiard table.
Figure 3:
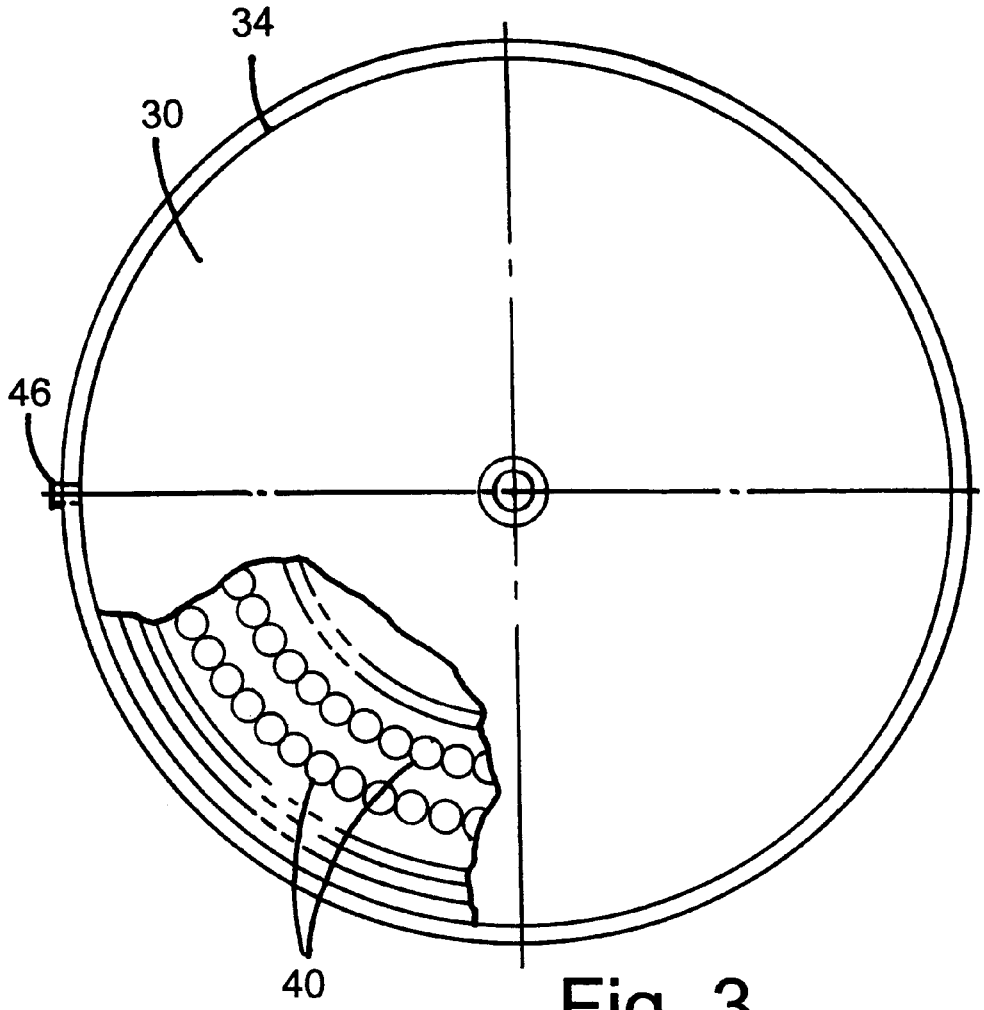
FIG. 3 is a plan view of the device in FIGS. 1 and 2.
Figure 2:
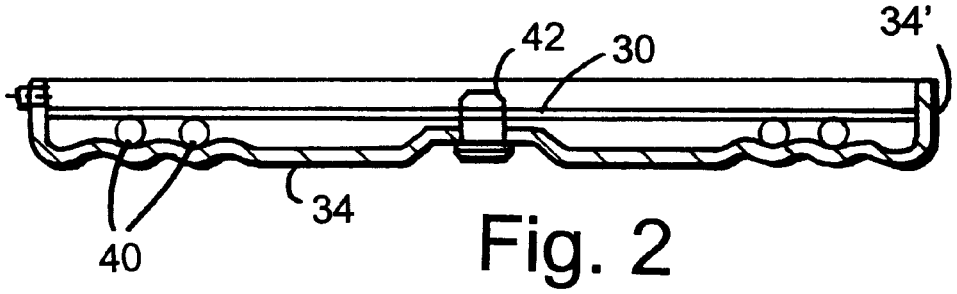
FIG. 2 is a sectional elevational view of the device in FIG. 1.
Figure 5:
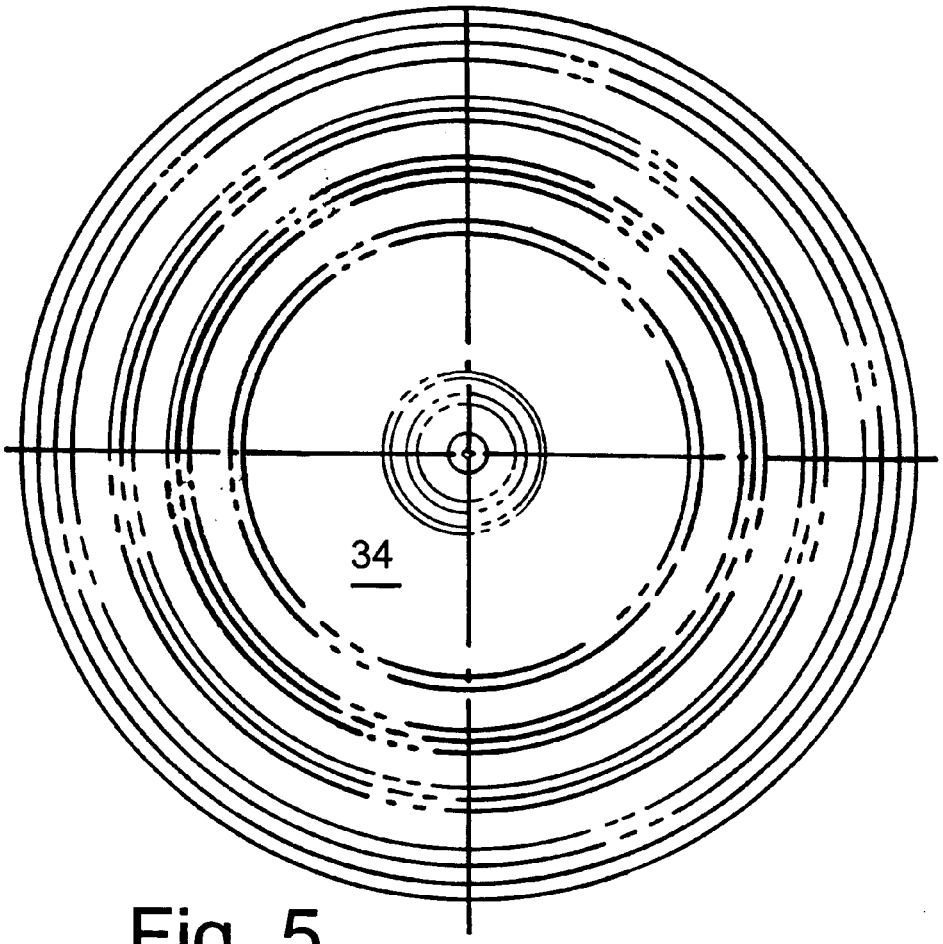
FIG. 5 is a bottom view of the dish portion in FIG. 4.
Figure 4:
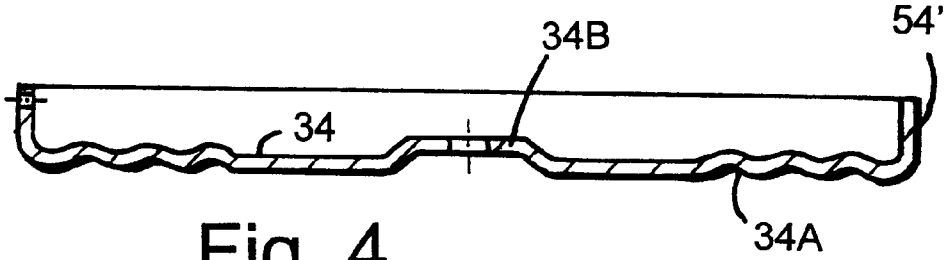
FIG. 4 is a sectional elevational view of the dish portion of the device.

Referring now specifically to the drawings, the adjusting assembly 10 there depicted is shown on the bottom of a billiard table leg 12, the leg having a foot subassembly 14 in cooperative combination with the adjuster subassembly 16.

Affixed to leg 12 is a threaded stud 20 depending therefrom and in threaded cooperation with a socket or nut 22 of the foot 24. Foot 24 is shown to include a frustoconical upper portion and a large-diameter lower portion which is circular in cross-section. The lower section rests on a flat, horizontal, circular support plate 30 of the adjusting device 16. This adjusting device includes a dish-type housing 32 which includes a bottom circular plate 34 and an upstanding peripheral rim 34'. Formed into bottom plate 34 is a pair of concentric circular bearing races 34A, each of which receives a plurality of ball bearings 40. The center of plate 34 includes an upwardly projecting boss 34B. A rotation axle 42 projects up through boss 34B, having a head on its lower end and a snap ring retainer 44 on its upper end. Beneath the snap ring retainer is plate 30, which rests on the two rings of ball bearings 40 and is retained by snap ring 44 thereabove.

Threadably engaged with rim 34' is at least one radially projecting set screw 46, the inner end of which is engageable with the table foot 24 to lock the foot in a particular rotated position after adjustment has been made.

To adjust the height of the leg of the billiard table, therefore, it is only necessary to manually grip the lower portion of foot 24 and rotate it, causing the threaded socket of the foot to elevate or lower on the threaded stud or shaft 20, thereby shortening or lengthening the leg to adjust the table playing surface. Once the proper position is achieved, set screw 46 is tightened against the foot to retain this position.

The above description is considered that of the preferred embodiment only. Modifications of the invention will occur to those skilled in the art and to those who make or use the invention. Therefore, it is understood that the embodiment shown in the drawings and described above is merely for illustrative purposes and not intended to limit the scope of the invention, which is defined by the following claims as interpreted according to the principles of patent law, including the doctrine of equivalents.

What is claimed is:

1. A billiard table leg and foot height adjuster, comprising:

a bottom plate including at least one concentric bearing race and an upstanding peripheral rim;

an upstanding boss in the center of said bottom plate;

a billiard table support plate resting on said at least one bearing race within said upstanding peripheral rim;

an axle having a lower end, and having an upper end projecting up through said boss and said support plate;

a snap ring retainer on said upper end of said axle for securing said support plate; and at least one set screw in said upstanding peripheral rim and projecting above said support plate to engage a billiard table foot.

2. The billiard table leg and foot height adjuster of claim 1, wherein said axle has a head on its lower end.

3. The billiard table leg and foot height adjuster of claim 1, further comprising a billiard table foot.

4. The billiard table leg and foot height adjuster of claim 3, wherein the upstanding peripheral rim has a minimum diameter greater than the diameter of said foot to receive the foot therein and is thereby retrofittable.

5. The billiard table leg and foot height adjuster of claim 4, wherein said foot further includes a threaded upper end for height adjustment.

6. The billiard table leg and foot height adjuster of claim 5,wherein said foot includes a frustoconical lower portion for rotatable adjustment of said foot by manually gripping the lower portion of said foot and rotating said foot and said support plate on said at least one bearing race.

7. The billiard table leg and foot height adjuster of claim 1, wherein said bottom plate includes a pair of concentric bearing races.

8. A billiard table leg and foot and height adjuster, comprising:

a bottom plate including at least one concentric bearing race and an upstanding peripheral rim;

an upstanding boss in the center of said bottom plate;

a billiard table support plate resting on said at least one bearing race within said upstanding peripheral rim;

an axle having a lower end, and having an upper end projecting up through said boss and said support plate;

a snap-ring retainer on said upper end of said axle for securing said support plate;

a billiard table foot of diameter D;

an upstanding peripheral rim having a minimum diameter greater than D, and is thereby retrofittable; and at least one set screw in said upstanding peripheral rim and projecting above said support plate to engage a billiard table foot.

9. The billiard table leg and foot and height adjuster of claim 8, wherein said foot further includes a threaded upper end allowing adjustment.

10. The billiard table leg and foot and height adjuster of claim 9, wherein said foot includes a frustoconical lower portion for rotatable adjustment of said foot by manually gripping the lower portion of said foot and rotating said foot.

11. A billiard table leg and foot height adjuster, comprising:

a bottom plate including at least one concentric bearing race and an upstanding peripheral rim;

an upstanding boss in the center of said bottom plate;

a billiard table support plate resting on said at least one bearing race within said upstanding peripheral rim;

an axle having a lower end, and having an upper end projecting through said boss and said support plate; and at least one set screw in said upstanding peripheral rim and projecting above the support plate to engage a billiard table foot.

12. The billiard table leg and foot height adjuster of claim 11, wherein said axle has a head on its lower head.

13. The billiard table leg and foot height adjuster of claim 11, further comprising a billiard table foot.

14. The billiard table leg and foot height adjuster of claim 13, wherein the upstanding peripheral rim has a minimum diameter greater than the diameter of said foot to receive the foot therein and is thereby retrofittable.

15. The billiard table leg and foot height adjuster of claim 14, wherein said foot further includes a threaded upper end for height adjustment.

16. The billiard table leg and foot height adjuster of claim 15, wherein said foot includes a frustoconical lower portion for rotatable adjustment of said foot by manually gripping the lower portion of said foot and rotating said foot and said support plate on said at least one bearing race.

17. The billiard table leg and foot height adjuster of claim 11, wherein said bottom plate includes a pair of concentric bearing races.

* * * * *

UNITED STATES PATENT AND TRADEMARK OFFICE

CERTIFICATE OF CORRECTION

PATENT NO. : 6,095,463
DATED : August 1, 2000
INVENTOR(S) : William R. McCormick It is certified that error appears in the above-identified patent and that said Letters Patent is hereby corrected as shown below:

[73] Assignee;
"Brunswick Billiards" should be --Brunswick Bowling & Billiards Corporation--.

Abstract, line 11;
"frust-oconical" should be --frustoconical--.

Col. 4, claim 12, line 2;
"lower head" should be --lower end--.

Signed and Sealed this

Fifteenth Day of May, 2001

Nicholas P. Godici

*Attest:*

NICHOLAS P. GODICI

*Attesting Officer*

*Acting Director of the United States Patent and Trademark Office*

UNITED STATES PATENT AND TRADEMARK OFFICE

CERTIFICATE OF CORRECTION

PATENT NO. : 6,095,463
DATED : August 1, 2000
INVENTOR(S) : William R. Mccormick It is certified that error appears in the above-identified patent and that said Letters Patent is hereby corrected as shown below:

Title page,
Item [73] Assignee should read - Brunswick Bowling & Billiards Corporation, Muskegon, Michigan --

Signed and Sealed this

Third Day of July, 2001

*Attest:*

Nicholas P. Godici

*Attesting Officer*

NICHOLAS P. GODICI
*Acting Director of the United States Patent and Trademark Office*